US007747214B2

(12) United States Patent
Kim et al.

(10) Patent No.: US 7,747,214 B2
(45) Date of Patent: Jun. 29, 2010

(54) MOBILE TERMINAL AND METHOD FOR PROVIDING USER INTERFACE USING RECEIVED TERRESTRIAL DIGITAL BROADCASTING DATA

(75) Inventors: Kang-Wook Kim, Daegu (KR); Jun-Ik Bae, Daegu (KR)

(73) Assignee: Samsung Electronics Co., Ltd (KR)

( * ) Notice: Subject to any disclaimer, the term of this patent is extended or adjusted under 35 U.S.C. 154(b) by 1157 days.

(21) Appl. No.: 11/364,753

(22) Filed: Feb. 28, 2006

(65) Prior Publication Data

US 2006/0194536 A1 Aug. 31, 2006

(30) Foreign Application Priority Data

Feb. 28, 2005 (KR) ..... 10-2005-0016718

(51) Int. Cl.
*H04H 1/00* (2006.01)

(52) U.S. Cl. ..... 455/3.01; 455/3.02; 455/3.06; 455/414.3; 455/150.1; 370/328; 370/329; 725/100; 725/118

(58) Field of Classification Search ..... 455/3.01, 455/3.02, 3.06, 414.1, 414.3, 422.1, 150.1, 455/151.1, 154.1, 176.1, 131; 370/328, 329, 370/395.1, 208; 725/118, 54, 39, 62, 134, 725/142, 38, 73, 100, 131, 139
See application file for complete search history.

(56) References Cited

U.S. PATENT DOCUMENTS

| | | | | |
|---|---|---|---|---|
| 6,415,135 | B1 * | 7/2002 | Salomaki | 455/45 |
| 6,859,501 | B1 * | 2/2005 | Zimmermann et al. | 375/260 |
| 7,623,485 | B2 * | 11/2009 | Bae et al. | 370/328 |
| 2004/0022326 | A1 * | 2/2004 | Morrish et al. | 375/316 |
| 2005/0055714 | A1 * | 3/2005 | Lee | 725/54 |

* cited by examiner

*Primary Examiner*—Tan Trinh
(74) *Attorney, Agent, or Firm*—The Farrell Law Firm, LLP

(57) ABSTRACT

A mobile terminal for receiving terrestrial digital broadcasting data and a method thereof are provided. A digital broadcasting receiver receives digital broadcasting data corresponding to a frequency in response to a request for digital broadcasting corresponding to the frequency. A demodulator separates a main service channel (MSC) containing broadcasting data for subchannels and a fast information channel (FIC) providing information about the MSC from the digital broadcasting data. A multimedia portion reads and outputs the FIC, and outputs broadcasting data of a subchannel according to a predetermined control signal. A controller acquires analysis information by analyzing the FIC and configures a user interface menu for the subchannels of the MSC using the analysis information.

41 Claims, 13 Drawing Sheets

| FIG type number | FIG type | FIG application |
|---|---|---|
| 0 | 000 | MCI and part of the SI |
| 1 | 001 | Labels, etc. (part of the SI) |
| 2 | 010 | Reserved |
| 3 | 011 | Reserved |
| 4 | 100 | Reserved |
| 5 | 101 | FIC Data Channel (FIDC) |
| 6 | 110 | Conditional Access (CA) |
| 7 | 111 | In house (except for Length 31) |

FIG.5B

MOBILE TERMINAL AND METHOD FOR PROVIDING USER INTERFACE USING RECEIVED TERRESTRIAL DIGITAL BROADCASTING DATA

PRIORITY

This application claims priority under 35 U.S.C. §119 to an application entitled "Mobile Terminal for Providing User Interface Using Received Terrestrial Digital Broadcasting Data and Method Thereof" filed in the Korean Intellectual Property Office on Feb. 28, 2005 and assigned Serial No. 2005-16718, the contents of which are incorporated herein by reference.

BACKGROUND OF THE INVENTION

1. Field of the Invention

The present invention relates generally to a mobile terminal, and in particular, to a mobile terminal and method for providing a user interface using received terrestrial digital broadcasting data.

2. Description of the Related Art

Generally, digital broadcasting improves on traditional analog broadcasting by providing better services with high quality in image and sound. Digital broadcasting is classified into satellite digital broadcasting and terrestrial digital broadcasting.

The main objective of the satellite digital broadcasting is to provide mobile services. It enables users to enjoy multichannel multimedia broadcasting using portable receivers (e.g. mobile phones or Personal Digital Assistants (PDAs)) or vehicle receivers at anytime and location.

The terrestrial digital broadcasting, which has its origin from Digital Audio Broadcasting (DAB), provides mobile multimedia broadcasting reception through the unused VHF channel 12. It is capable of delivering an ensemble of services that includes television, radio and data broadcasting. Existing terrestrial providers operate one analog channel, whereas digital broadcasting providers operate a plurality of digital channels.

In the terrestrial digital broadcasting, one channel is divided into three blocks, and it is expected that two video channels per block or one video channel and three to four audio channels per block will be created. The terrestrial digital broadcasting aims to provide free broadcasting, considering reception in vehicles. Several service providers plan to provide the terrestrial digital broadcasting in the near future.

Along with the development of digital broadcasting technology and mobile communication technology in recent years, the public has shown an increasing interest in digital broadcasting services that enable viewing digital broadcasting during roaming, particularly in Digital Multimedia Broadcasting (DMB) supporting mobile multimedia broadcasting data through mobile terminals.

Accordingly, there is a need for providing a user interface that enables efficient viewing of the terrestrial digital broadcasting over multiple channels through a mobile terminal.

SUMMARY OF THE INVENTION

An object of the present invention is to substantially solve at least the above problems and/or disadvantages, and to provide a mobile terminal and method for enabling users to efficiently view terrestrial digital broadcasting.

Another object of the present invention is to provide a mobile terminal and method for providing a user interface using received terrestrial digital broadcasting data.

According to one aspect of the present invention, a digital broadcasting receiver receives digital broadcasting data corresponding to a frequency in response to a request for digital broadcasting corresponding to the frequency. A demodulator separates a main service channel (MSC) containing broadcasting data for subchannels and a fast information channel (FIC) providing information about the MSC from the digital broadcasting data. A multimedia portion reads and outputs the FIC, and outputs broadcasting data of a subchannel according to a predetermined control signal. A controller acquires analysis information by analyzing the FIC and configures a user interface menu for the subchannels of the MSC using the analysis information.

It is preferred that the mobile terminal further includes a display for displaying the user interface menu configured by the controller and a memory for storing the analysis information.

According to another aspect of the present invention, in a mobile terminal for receiving digital broadcasting data, a digital broadcasting receiver receives digital broadcasting data corresponding to a frequency in response to a request for digital broadcasting corresponding to the frequency. A demodulator separates an MSC containing broadcasting data for subchannels and an FIC providing information about the MSC from the digital broadcasting data. A multimedia portion acquires analysis information by analyzing the FIC, outputs the analysis information, and outputs broadcasting data of a subchannel according to a predetermined control signal. A controller configures a user interface menu for the subchannels of the MSC using the analysis information.

It is preferred that the mobile terminal further includes a display for displaying the user interface menu configured by the controller and a memory for storing the analysis information.

According to a further aspect of the present invention, in a mobile terminal for receiving digital broadcasting data, a digital broadcasting receiver receives digital broadcasting data corresponding to a frequency in response to a request for digital broadcasting corresponding to the frequency. A demodulator separates an MSC containing broadcasting data for subchannels and an FIC providing information about the MSC from the digital broadcasting data. A multimedia portion acquires analysis information by analyzing the FIC, configures a user interface menu for the subchannels of the MSC using the analysis information, and outputs broadcasting data of a subchannel according to a predetermined control signal. A controller provides overall control to the mobile terminal.

It is preferred that the mobile terminal further includes a display for displaying the user interface menu configured by the multimedia portion and a memory for storing the analysis information acquired by the multimedia portion.

According to still another aspect of the present invention, in a method of configuring a user interface in a mobile terminal for receiving terrestrial digital broadcasting data, in response to a request for digital broadcasting corresponding to a frequency, digital broadcasting data corresponding to the frequency is received. An MSC containing broadcasting data for subchannels and an FIC providing information about the MSC are separated from the digital broadcasting data. Analysis information is acquired by analyzing the FIC and a user interface menu for the subchannels of the MSC is configured using the analysis information.

It is preferred that the user interface menu is displayed.

BRIEF DESCRIPTION OF THE DRAWINGS

The above and other objects, features and advantages of the present invention will become more apparent from the following detailed description when taken in conjunction with the accompanying drawings in which:

FIGS. 5A and 5B illustrate the structure of a FIC required to provide a user interface in the mobile terminal according to the embodiment of the present invention;

DETAILED DESCRIPTION OF THE PREFERRED EMBODIMENT

A preferred embodiment of the present invention will be described herein below with reference to the accompanying drawings. In the following description, well-known functions or constructions are not described in detail for the sake of clarity.

Figure 1:
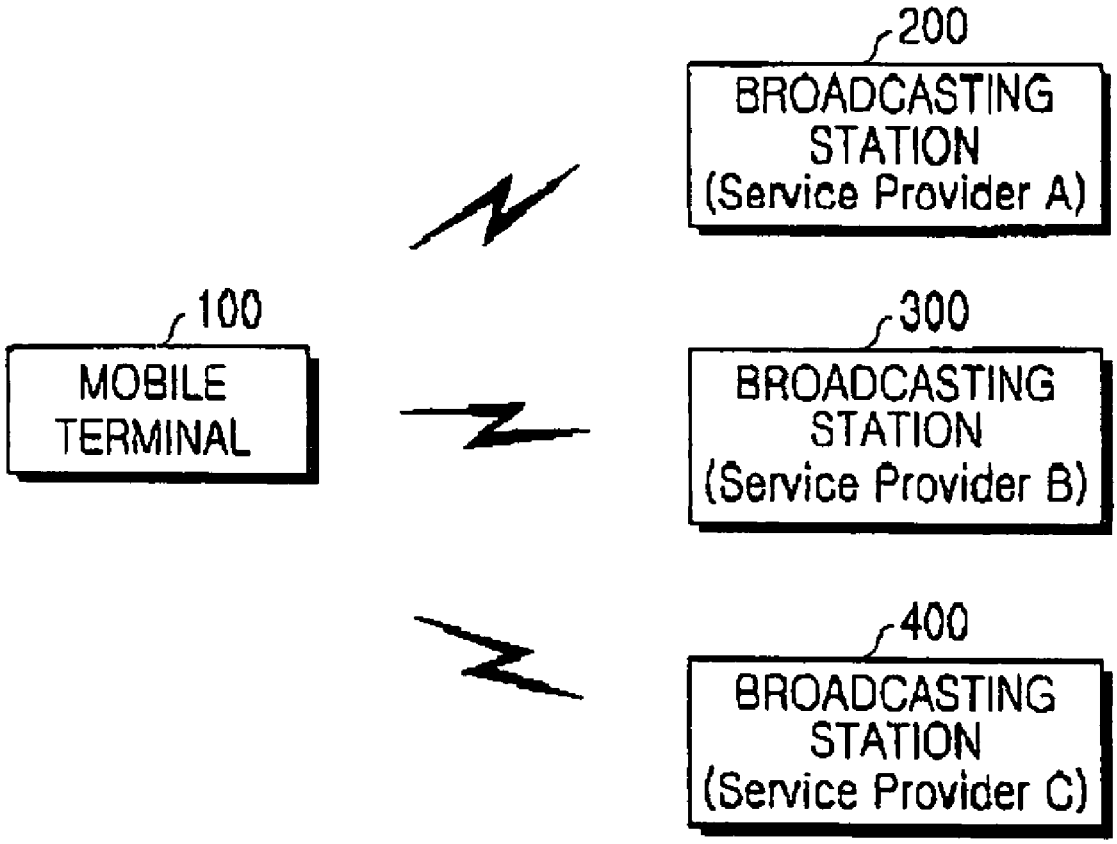
FIG. 1 illustrates the configuration of a system for providing a terrestrial digital broadcasting service to which the present invention is applied.

FIG. 1 illustrates the configuration of a system for providing a terrestrial digital broadcasting service to which the present invention is applied.

Referring to FIG. 1, a mobile terminal 100, which is terrestrial digital broadcasting-enabled, provides a digital broadcasting service to a user by outputting digital broadcasting data received from broadcasting stations 200, 300 and 400 through a display (not shown) and a speaker (not shown). The broadcasting stations 200, 300 and 400 transmit digital broadcasting at their specific frequencies.

Figure 2:
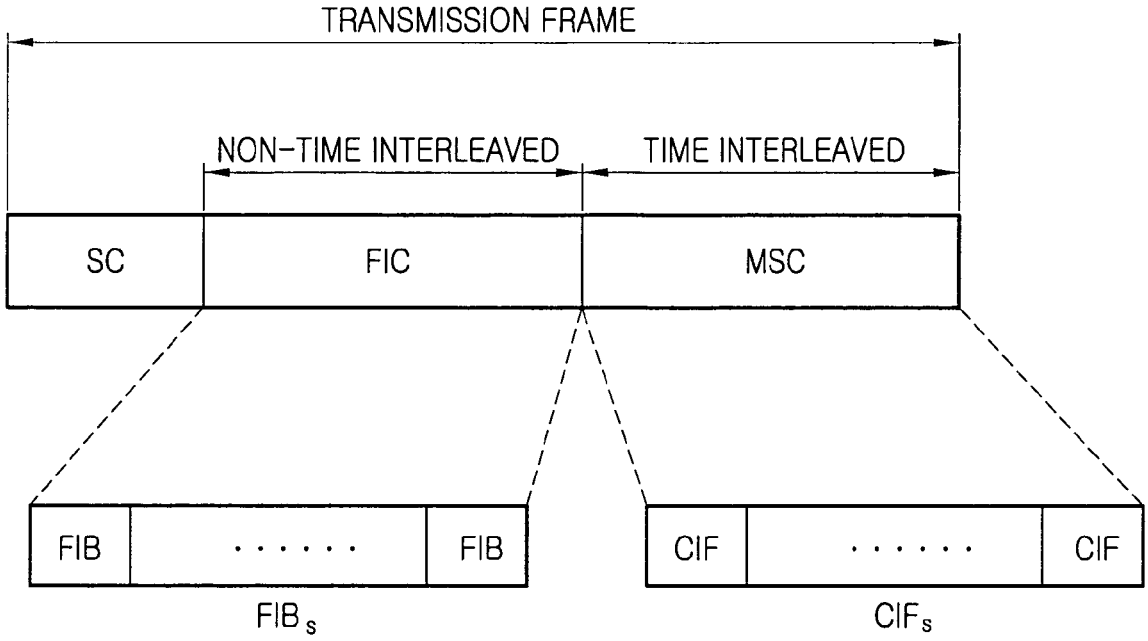
FIG. 2 illustrates the structure of a transmission frame for the terrestrial digital broadcasting service to which the present invention is applied.

FIG. 2 illustrates the structure of a transmission frame for the terrestrial digital broadcasting service to which the present invention is applied.

Referring to FIG. 2, the transmission frame for terrestrial digital broadcasting is the same in configuration as that for DAB. The transmission frame is composed of a Synchronization Channel (SC), an FIC and a Main Information Channel (MIC).

The FIC carries 12 Fast Information Blocks (FIBs) over a 96-ms time period, for delivering control information needed to interpret the configuration of the MSC. The key element of the control information is Multiplex Configuration Information (MCI) also containing, when necessary, multiplex reconfiguration information. Other information that can be included in the FIC is Service Information (SI), Conditional Access (CA) management information and a Fast Information Data Channel (FIDC).

The MIC has a sequence of Common Interleaved Frames (CIFs). A CIF is 55,296 bits long and transmitted every 24 ms. The smallest unit to which an address is allocated in a CIF is a Capacity Unit (CU), the size of which is 64 bits. A plurality of concatenated CUs constitute the basic transport unit of MIC, called a subchannel. Therefore, the MIC is composed of multiplexed subchannels including video channels, audio channels and data channels.

The MCI is delivered on the FIC, which defines the configuration of a multiplex of terrestrial digital broadcasting. The structure of the MSC will be described with reference to FIG. 3.

Figure 3:
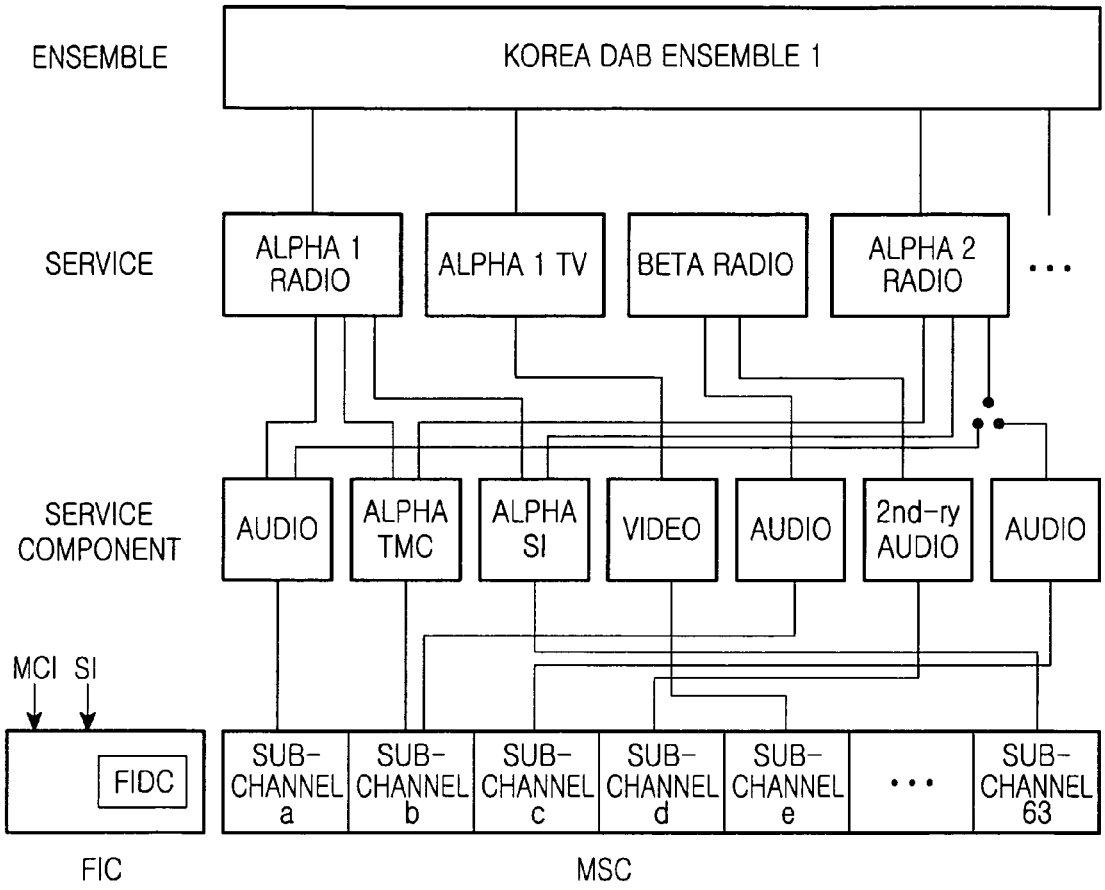
FIG. 3 illustrates the structure of a multiplex of terrestrial digital broadcasting to which the present invention is applied.

FIG. 3 illustrates the structure of a multiplex of terrestrial digital broadcasting to which the present invention is applied.

Referring to FIG. 3, the MCI provides information about subchannel organization, a list of services available in an ensemble, mapping between services and service components, mapping between subchannels and service components, and multiplex reconfiguration management information. The ensemble is a set of broadcasting services including still images, moving pictures, radio broadcasting, and data broadcasting like a set of signals with different characteristics, transmitted in a multiplex and received through a receiver. That is, the ensemble is the uppermost-layer container with audio, video and data services of digital broadcasting.

Figure 4:
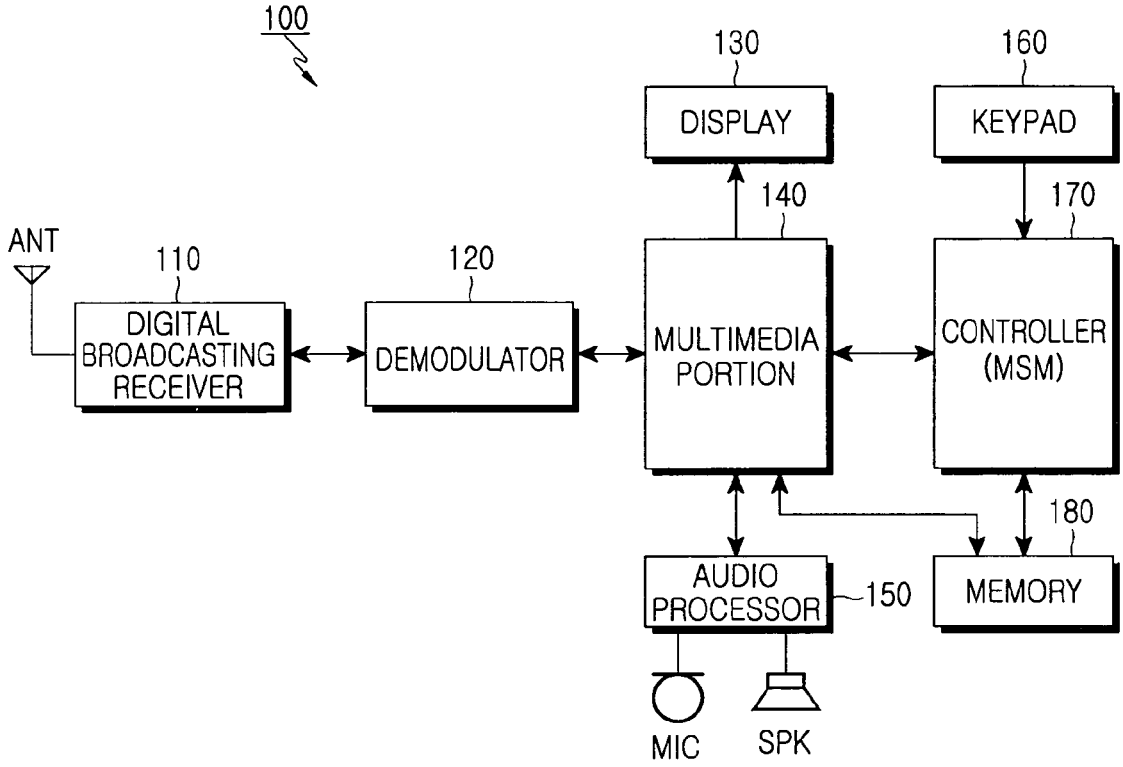
FIG. 4 is a block diagram of a mobile terminal according to an embodiment of the present invention.

FIG. 4 is a block diagram of a mobile terminal according to an embodiment of the present invention.

Referring to FIG. 4, the mobile terminal 100 includes a digital broadcasting receiver 110, a demodulator 120, a display 130, a multimedia portion 140, an audio processor 150, a keypad 160, a controller 170 (e.g. MSM6500), and a memory 180.

The digital broadcasting receiver 110 receives digital broadcasting data at predetermined frequencies from predetermined broadcasting stations under the control of the controller 170.

The demodulator 120 separates an MSC including broadcasting data for each subchannel (video channel, audio channel and data channel) and an FIC including information about the MSC from the received digital broadcasting data. The MSC has broadcasting data (i.e. actual audio/video data (MPEG2-TS)). Preferably, the demodulator 120 includes a buffer for buffering the FIC.

The display 130, which may be a Liquid Crystal Display (LCD), displays digital broadcasting data received from the digital broadcasting receiver 110 under the control of the controller 170. According to the embodiment of the present invention, the display 130 also displays a user interface menu configured by the controller 170 so that the user may select a desired subchannel item through the keypad 160.

While not shown in FIG. 4, the display 130 can output On-Screen Display (OSD) data according to a displayed screen size through a video processor (not shown) with an OSD function.

The multimedia portion 140, upon request for digital broadcasting at the frequency of a particular broadcasting station from the user, tunes the frequency of the digital broadcasting receiver 110 to the particular frequency. Thus, the digital broadcasting receiver 110 can receive digital broadcasting data from the user-desired broadcasting station. The multimedia portion 140 also reads the FIC separated from the digital broadcasting data by the demodulator 120 and bypasses the FIC to the controller 170.

The multimedia 140 parses broadcasting data for each subchannel under the control of the controller 170 and outputs the parsed broadcasting data through the display 130 and the audio processor 150.

The multimedia portion 140 may have an additional memory (not shown) for storing predetermined broadcasting data during output of the broadcasting data for each subchannel. Alternatively, the multimedia portion 140 transmits the predetermined broadcasting data to the memory 180 to be stored.

The audio processor 150 can be provided with a Coder-Decoder (CODEC). The CODEC has a data CODEC for processing packet data and an audio CODEC for processing audio signals such as voice.

The audio processor 150 modulates an electrical signal received from a microphone to voice data. It also demodulates coded voice data received from a radio transmitter/receiver (not shown) or the digital broadcasting receiver 110 to an electrical signal and outputs the electrical signal through the speaker. The audio processor 150 is preferably provided with a CODEC for converting a digital audio signal received from the radio transmitter/receiver or the digital broadcasting receiver 110 to an analog signal, or converting an analog audio signal generated from the microphone to a digital audio signal. The CODEC includes a data CODEC for processing packet data and an audio CODEC for processing audio signals such as voice. The CODEC can be incorporated in the controller 170.

The keypad 160 is configured in a key matrix structure (not shown) including alphanumerical keys and function keys, for providing a key input signal corresponding to a key pressed by the user to the controller 170.

The controller 170 provides overall control to the operation of the mobile terminal 100 according to the embodiment of the present invention. Upon request for digital broadcasting at the frequency of a particular broadcasting station from the user, the controller 170 provides information about the broadcasting station, particularly, frequency information stored in the memory 180 to the multimedia portion 140.

The controller 170 analyzes the FIC bypassed from the multimedia portion 140, stores the analysis information in the memory 180, configures a user interface menu for the subchannels of the MSC using the analysis information. The manner in which the controller 170 analyzes the FIC will be described later herein. The analysis information contains an ensemble label indicating the name of the broadcasting station, a service label indicating a channel name, service identifiers (ID) identifying services, service data types indicating audio, video or data, service component IDs identifying service components (e.g. a component indicating that broadcasting data includes audio and video data), subchannel IDs identifying subchannels, and subchannel data types. That is, the controller 170 can discern which subchannel is a video, audio or data channel and the title of the subchannel by analyzing the FIC.

The user interface menu is preferably configured to provide the digital broadcasting data received from the broadcasting station by subchannel items.

The controller 170 displays the user interface menu on the display 130. Upon the user's selection of a particular subchannel item, such as a video channel on the user interface menu, the controller 170 transmits the data type and ID of the selected subchannel to the multimedia portion 140 so that corresponding broadcasting data is output.

Meanwhile, after the multimedia portion 140 reads the FIC separated by the demodulator 120, the multimedia portion 140 can analyze the FIC without bypassing the FIC to the controller 170, and provide the analysis information to the controller 170.

In addition, the multimedia portion 140 can configure the user interface menu using the analysis information without providing the analysis information to the controller 170, and display the user interface menu.

The memory 180 stores information needed for controlling the operation of the mobile terminal 100. The memory 180 also stores frequency information about predetermined broadcasting stations that transmit digital broadcasting at their specific frequencies. The memory 180 stores the analysis information about the FIC that the controller 170 provides to configure the user interface menu.

Figure 5A:
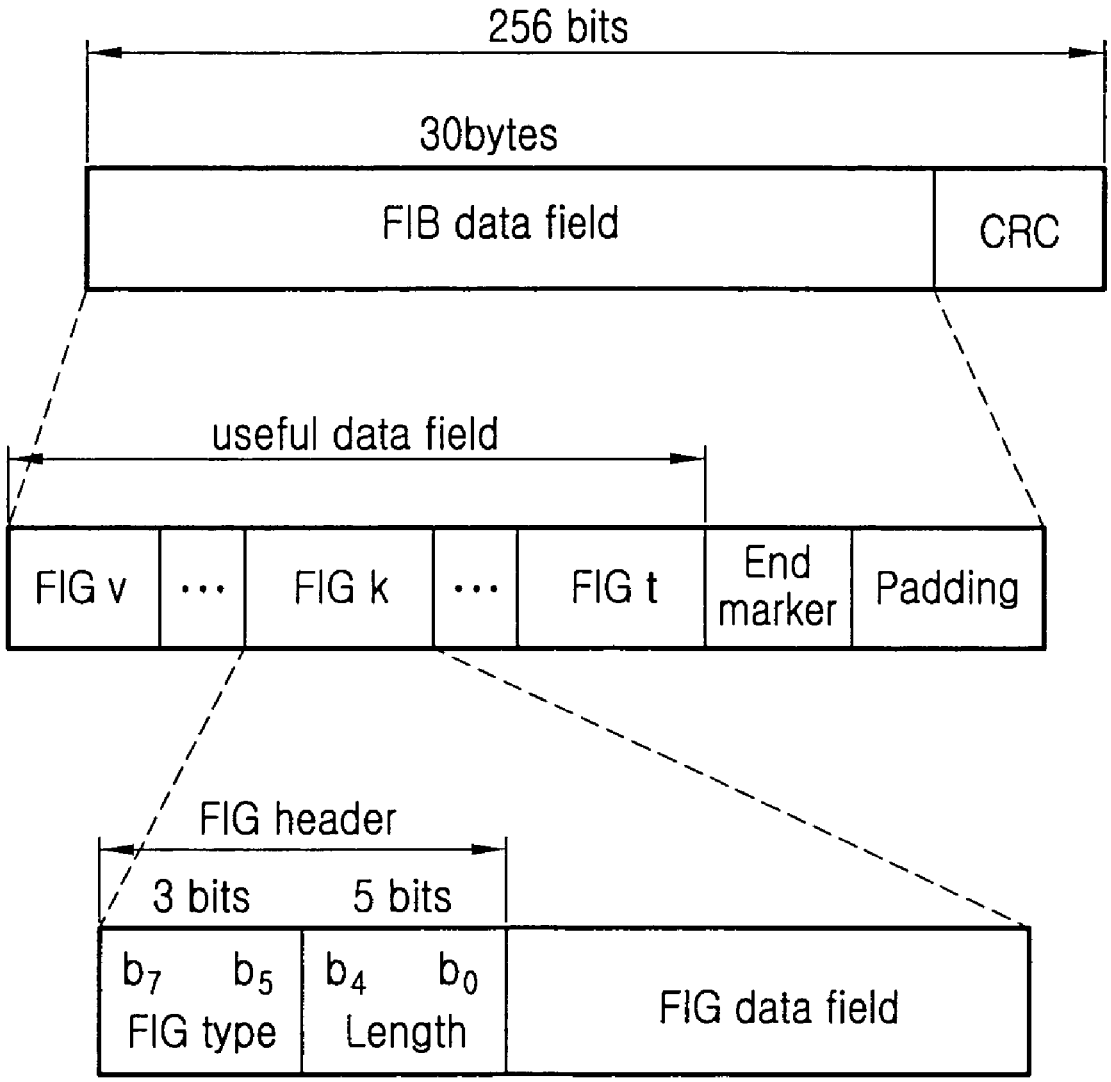

FIGS. 5A and 5B illustrate the structure of a FIC required to provide a user interface in the mobile terminal according to the embodiment of the present invention.

Referring to FIGS. 5A and 5B, the 12 FIBs of the FIC are configured as illustrated in FIG. 5A. Each FIB includes Fast Information Groups (FIGs) each having an FIG header and an FIG data field.

The FIG header has an FIG Type and a Length regarding the FIG. Eight FIG types are available as illustrated in FIG. 5B. The Length indicates the length of the FIG data.

Referring to FIG. 5B, among the eight FIG types, FIG type 0 and FIG type 1 are required to configure the user interface in the controller of the mobile terminal. Thus, the following description focuses on the two types with reference to FIGS. 6A to 6H.

FIGS. 6A to 6H illustrate data field structures for the FIC required to provide a user interface in the mobile terminal of the present invention.

Figure 6A:
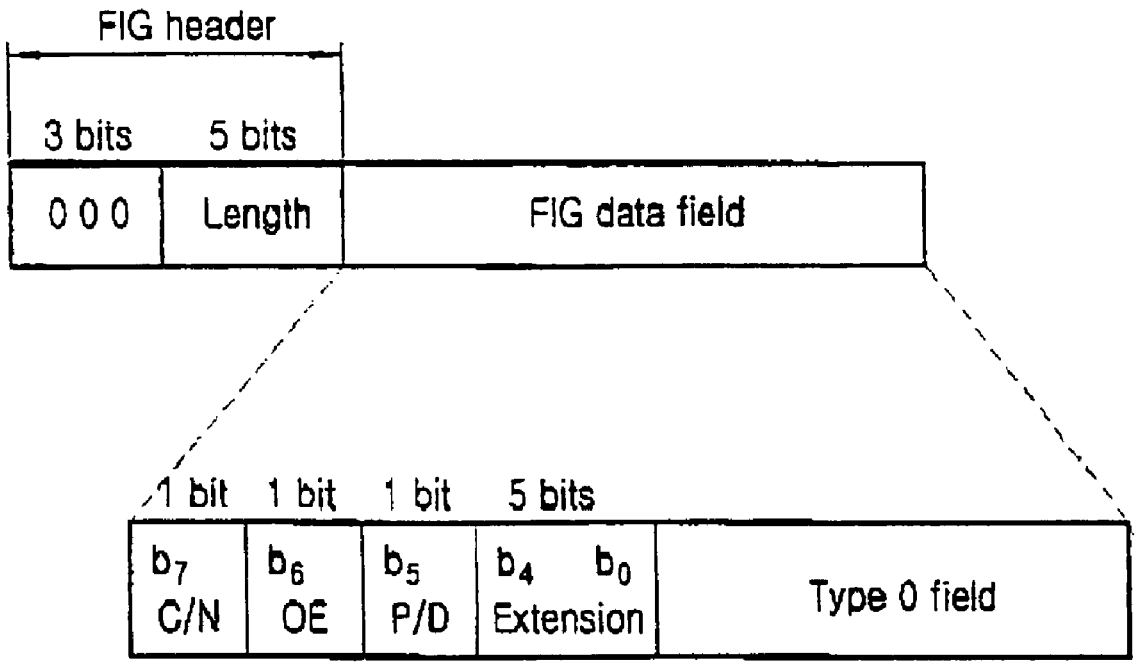
FIGS. 6A to 6H illustrate data field structures for the FIC required to provide a user interface in the mobile terminal according to the embodiment of the present invention.

FIG. 6A illustrates a data field structure for FIG Type 0. FIG Type 0 can be branched into about 32 types according to Extension. For FIG Type 0, the controller of the mobile terminal needs Extensions 1, 2 and 3 for providing the user interface of the present invention. Thus, only Extensions 1, 2 and 3 will be described.

Figure 6B:
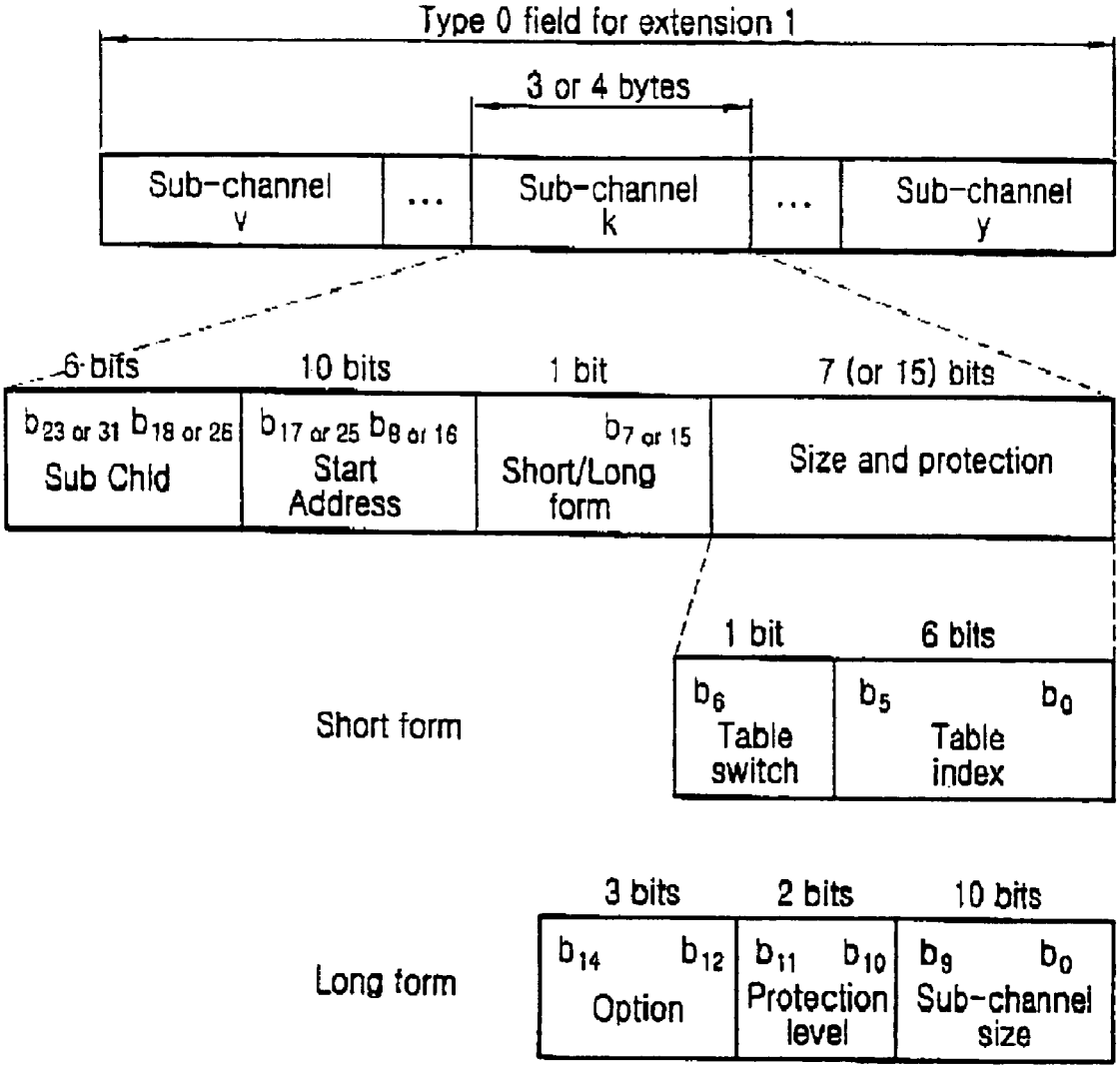

FIG. 6B illustrates the structure of a subchannel organization field for FIG type 0 with Extension 1, which provides information about subchannel organization. From this information, the mobile terminal 100 has knowledge of subchannel IDs, start addresses and channel sizes.

Figure 6C:
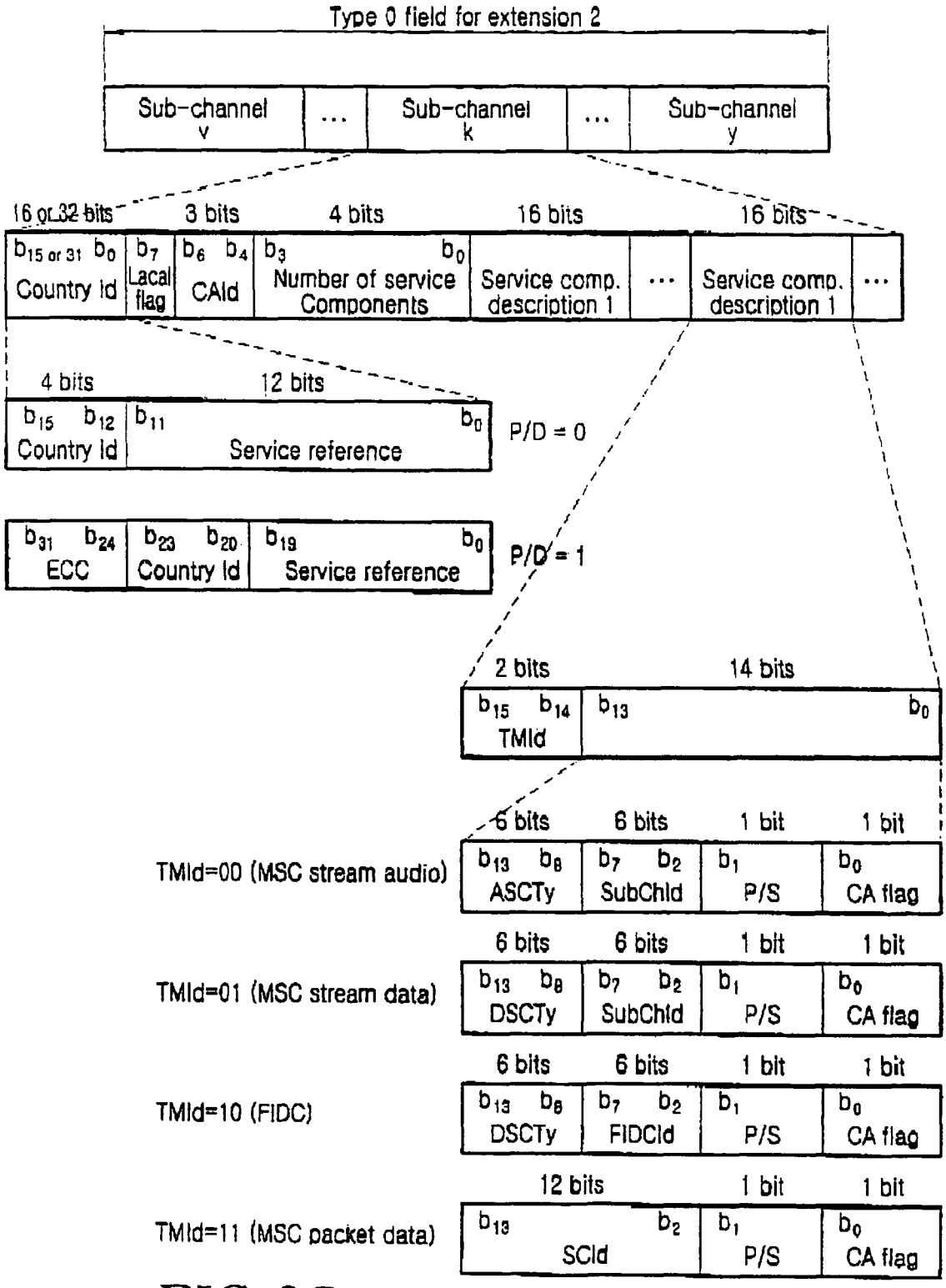

FIG. 6C illustrates the structure of a subchannel organization field for FIG Type 0 with Extension 2, which provides information about a basic service and service components. From this information, the mobile terminal 100 has knowledge of a service ID and a service data type (i.e. video, audio or data).

Figure 6D:
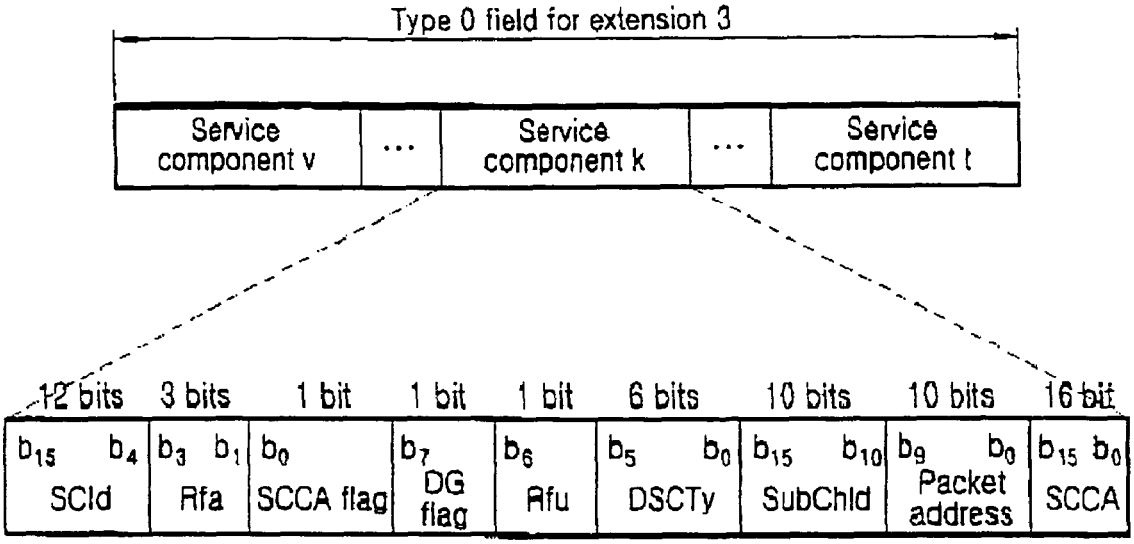
Figure 6E:
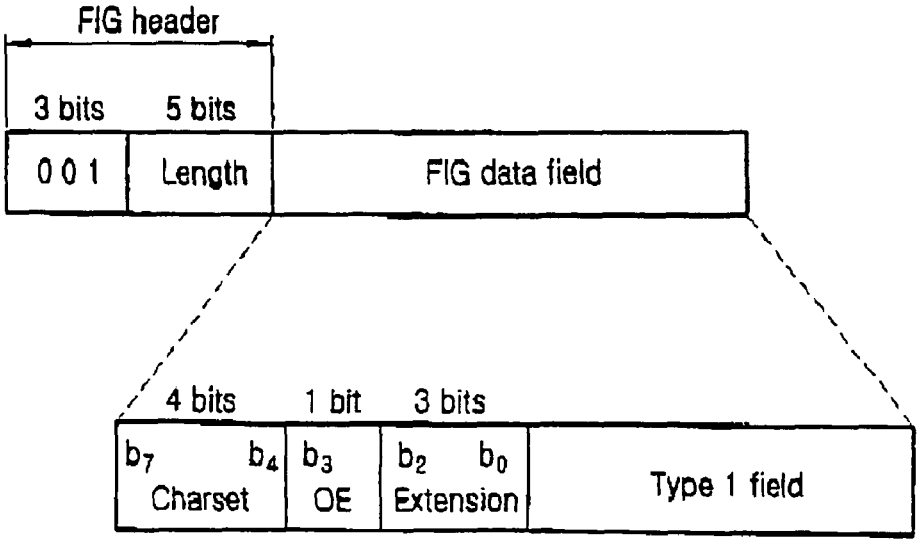

FIG. 6D illustrates the structure of a service component field for FIG Type 0 with Extension 3, which provides information about service components in a packet mode. From this information, the mobile terminal 100 has knowledge of service component IDs and packet addresses FIG. 6E illustrates a data field structure for FIG type 1. Referring to FIG. 6E, FIG type 1 can be branched into about 6 types according to Extension. For FIG type 1, the controller of the mobile terminal needs Extensions 0, 1, and 5 for providing the user interface of the present invention. Thus, only Extensions 0, 1 and 5 will be described.

Figure 6F:
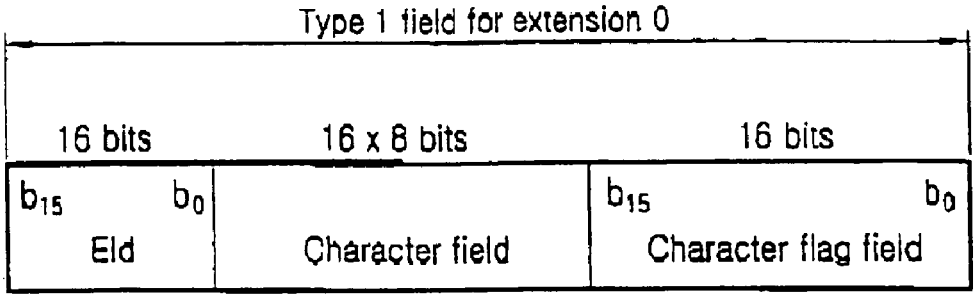

FIG. 6F illustrates the structure of an ensemble label field for FIG type 1 with Extension 0, which provides information about an ensemble label. From this information, the mobile terminal 100 determines an ensemble label for the user interface.

Figure 6G:
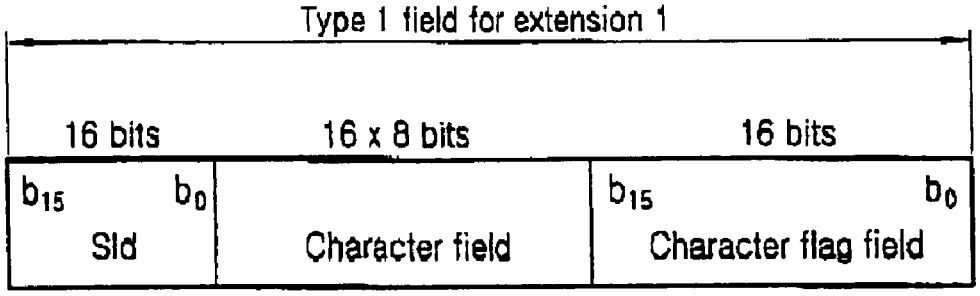

FIG. 6G illustrates the structure of a service label field for FIG Type 1 with Extension 1, which provides information about a basic service and service components. From this information, the mobile terminal 100 determines a service label for the user interface.

Figure 6H:
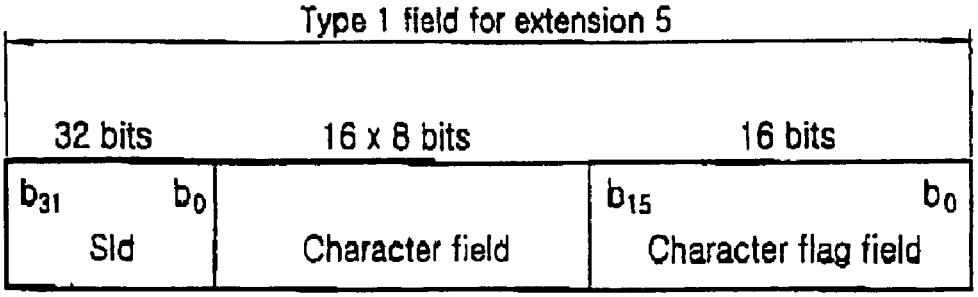

FIG. 6H illustrates the structure of a data service label field for FIG Type 1 with Extension 5, which provides information about a data service label. From this information, the mobile terminal 100 determines a data service label for the user interface.

The embodiment of the present invention is based on the assumption that the mobile terminal 100 can receive six pieces of information (FIG type 0/Extension 1, FIG type 0/Extension 2, FIG type 0/Extension 3, FIG type 1/Extension 0, FIG type 1/Extension 1, and FIG type 1/Extension 5) required to configure a user interface in ten 96-ms frames (960 ms) from all broadcasting stations that transmit terrestrial digital broadcasting.

The mobile terminal 100 stores the six pieces of information described in FIGS. 5A to 6H in the memory and configures a user interface by ordering the stored information.

Figure 7:
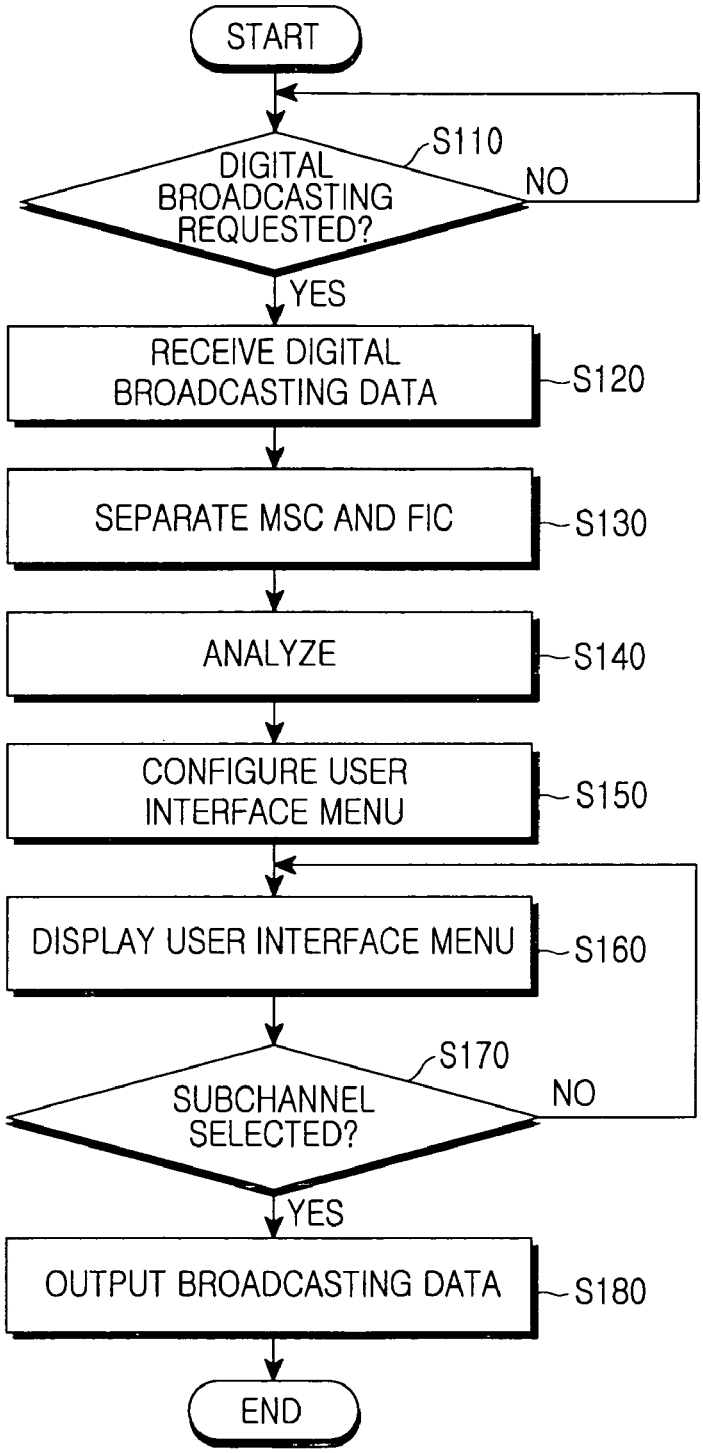
FIG. 7 is a flowchart illustrating an operation for providing a user interface using received terrestrial digital broadcasting data in the mobile terminal according to the embodiment of the present invention.

FIG. 7 is a flowchart illustrating an operation for providing a user interface using received terrestrial digital broadcasting data in the mobile terminal of the present invention.

Referring to FIGS. 4 and 7, the controller 170 determines whether a request for digital broadcasting at the frequency of a particular broadcasting station has been received from the user in step S110. Upon receipt of the digital broadcasting request, the controller 170 provides information about the broadcasting station (i.e. frequency information) stored in the memory 180 to the multimedia portion 140, which tunes the digital broadcasting receiver 110 to the frequency of the broadcasting station so that the digital broadcasting receiver 110 can receive digital broadcasting data from the user-intended broadcasting station.

Upon receipt of digital broadcasting data at the requested frequency at the digital broadcasting receiver 110 in step S120, the demodulator 120 separates the MSC and the FIC from the received digital broadcasting data in step S130.

The controller 170 analyzes the FIC received from the multimedia portion 140 and acquires the analysis information about the FIC in step S140. Preferably, the multimedia portion 140 provides the FIC continuously to the controller 170 for 960 ms. This is because the controller 170 can receive the six pieces of information required to configure a user interface in ten 96-ms frames (960 ms) from all broadcasting stations that transmit terrestrial digital broadcasting, as described above.

Meanwhile, the controller 170 preferably analyzes FIC data of 960 ms, extracts the six pieces of information as analysis information and stores them in the memory 180. The analysis information includes an ensemble label, a service label, service IDs, service data types, service component IDs, subchannel IDs and subchannel data types.

The controller 170 configures a user interface menu with respect to the subchannels of the MSC based on the analysis information in step S150 and displays the user interface menu on the display 130 in step S160. In step S170, the controller 170 monitors selection of a particular subchannel through the user interface menu.

Upon selection of a particular subchannel item, the controller 170 controls the multimedia portion 140 to output broadcasting data on the selected subchannel through the display 130 and the audio processor 150 in step S180. That is, the controller 170 reads information about the selected subchannel and transmits the subchannel information to the multimedia portion 140. The multimedia portion 140 provides the subchannel information to the demodulator 120 and outputs the digital broadcasting data through the display 130 and the audio processor 150.

While it has been described that the controller 170 analyzes the FIC in the procedure of FIG. 7, the multimedia 140 can analyze the FIC and provide the analysis information to the controller 170. In addition, instead of providing the analysis information to the controller 170, the multimedia 140 can directly configure a user interface menu using the analysis information and display the user interface menu on the display 130.

Figure 8A:
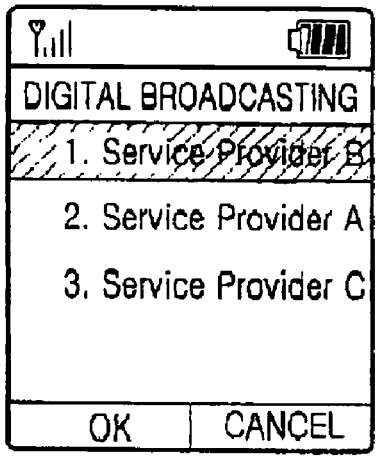
FIGS. 8A, 8B and 8C illustrate a sequence of displays showing the operation of the mobile terminal according to the embodiment of the present invention.
Figure 8B:
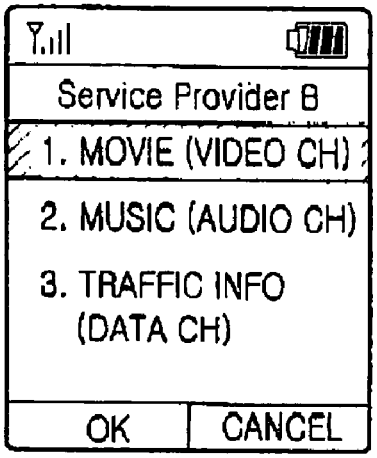
Figure 8C:
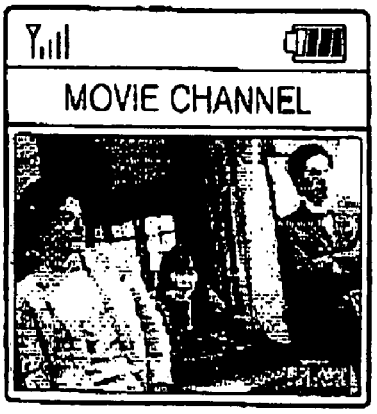

FIGS. 8A, 8B and 8C illustrate a sequence of displays showing the operation of the mobile terminal according to the present invention.

FIGS. 8A, 8B and 8C will be described with reference to FIG. 7.

FIG. 8A illustrates a display listing broadcasting stations from which the user can select to receive broadcasting data. In the embodiment of the present invention, three terrestrial digital broadcasting providers A, B and C are assumed. In FIG. 8A, the mobile terminal provides a main user interface for three frequencies.

When the user selects "1. Service Provider B" by key manipulation and presses an OK key, a user interface menu listing subchannels for carrying digital broadcasting data from Service Provider B is provided on the display through steps S110 to S160 of FIG. 7, as illustrated in FIG. 8B.

FIG. 8B illustrates "1. Movie (Video CH)", "2. Music (Audio CH)", and "3. Traffic Info (Data CH)" as subchannel items.

If the user selects 1. "Movie (Video CH)" and presses the OK key, the mobile terminal outputs broadcasting data on the selected subchannel in steps 170 and S180, as illustrated in FIG. 8C.

As described before, the present invention provides a mobile terminal and method for providing a user interface using received terrestrial digital broadcasting data. Therefore, users can efficiently view terrestrial digital broadcasting on their mobile terminals.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A mobile terminal for receiving terrestrial digital broadcasting data, comprising:

a digital broadcasting receiver for receiving digital broadcasting data corresponding to a frequency in response to a request for digital broadcasting corresponding to the frequency;

a demodulator for separating a main service channel (MSC) containing broadcasting data for subchannels and a fast information channel (FIC) providing information about the MSC from the digital broadcasting data;

a multimedia portion for reading and outputting the FIC and outputting broadcasting data of a subchannel according to a control signal; and a controller for acquiring analysis information by analyzing the FIC and configuring a user interface menu for the subchannels of the MSC using the analysis information.

2. The mobile terminal of claim 1, wherein the subchannels include at least one of a video channel, an audio channel and a data channel.

3. The mobile terminal of claim 1, further comprising a display for displaying the user interface menu.

4. The mobile terminal of claim 1, further comprising a memory for storing the analysis information.

5. The mobile terminal of claim 1, wherein the analysis information includes at least on of an ensemble label, a service label, a service identifier (ID), a service data type, a service component ID, a subchannel ID and a subchannel data type.

6. The mobile terminal of claim 1, wherein the demodulator includes a buffer for buffering the FIC.

7. The mobile terminal of claim 1, wherein upon selection of a subchannel through the user interface menu, the controller controls the multimedia portion to output broadcasting data of the selected subchannel.

8. The mobile terminal of claim 7, wherein upon selection of a subchannel through the user interface menu, the controller provides to the multimedia portion a signal indicating data type and ID of the selected subchannel.

9. The mobile terminal of claim 1, wherein upon selection of a subchannel through the user interface menu, the controller provides to the multimedia portion a signal indicating data type and ID of the selected subchannel.

10. The mobile terminal of claim 1, wherein upon receipt of a signal indicating data type and ID of a subchannel from the controller, the multimedia portion receives from the demodulator broadcasting data of the subchannel and outputs the broadcasting data.

11. A mobile terminal for receiving digital broadcasting data, comprising:

a digital broadcasting receiver for receiving digital broadcasting data corresponding to a frequency in response to a request for digital broadcasting corresponding to the frequency;

a demodulator for separating a main service channel (MSC) containing broadcasting data for subchannels and a fast information channel (FIC) providing information about the MSC from the digital broadcasting data;

a multimedia portion for acquiring analysis information by analyzing the FIC, outputting the analysis information and outputting broadcasting data of a subchannel according to a predetermined control signal; and a controller for configuring a user interface menu for the subchannels of the MSC using the analysis information.

12. The mobile terminal of claim 11, wherein the subchannels include at least one of a video channel, an audio channel and a data channel.

13. The mobile terminal of claim 11, further comprising a display for displaying the user interface menu.

14. The mobile terminal of claim 11, further comprising a memory for storing the analysis information.

15. The mobile terminal of claim 11, wherein the analysis information includes at least one of an ensemble label, a service label, a service identifier (ID), a service data type, a service component ID, a subchannel ID and a subchannel data type.

16. The mobile terminal of claim 11, wherein the demodulator includes a buffer for buffering the FIC.

17. The mobile terminal of claim 11, wherein upon selection of a subchannel through the user interface menu, the controller controls the multimedia portion to output broadcasting data of the selected subchannel.

18. The mobile terminal of claim 17, wherein upon selection of a subchannel through the user interface menu, the controller provides a signal indicating data type and ID of the selected subchannel to the multimedia portion.

19. The mobile terminal of claim 11, wherein upon selection of a subchannel through the user interface menu, the controller provides a signal indicating data type and ID of the selected subchannel to the multimedia portion.

20. The mobile terminal of claim 11, wherein upon receipt of a signal indicating data type and ID of a subchannel from the controller, the multimedia portion reads broadcasting data of the subchannel from the demodulator and outputs the broadcasting data.

21. A mobile terminal for receiving digital broadcasting data, comprising:

a digital broadcasting receiver for receiving digital broadcasting data corresponding to a frequency in response to a request for digital broadcasting corresponding to the frequency;

a demodulator for separating a main service channel (MSC) containing broadcasting data for subchannels and a fast information channel (FIC) providing information about the MSC from the digital broadcasting data;

a multimedia portion for acquiring analysis information by analyzing the FIC, configuring a user interface menu for the subchannels of the MSC using the analysis information, and outputting broadcasting data of a subchannel according to a predetermined control signal; and a controller for controlling the mobile terminal.

22. The mobile terminal of claim 21, wherein the subchannels include at least one of a video channel, an audio channel and a data channel.

23. The mobile terminal of claim 21, further comprising a display for displaying the user interface menu.

24. The mobile terminal of claim 21, further comprising a memory for storing the analysis information under the control of the controller.

25. The mobile terminal of claim 21, wherein the analysis information includes at least one of an ensemble label, a service label, a service identifier (ID), a service data type, a service component ID, a subchannel ID and a subchannel data type.

26. The mobile terminal of claim 21, wherein the demodulator includes a buffer for buffering the FIC.

27. The mobile terminal of claim 21, wherein upon selection of a subchannel through the user interface menu, the controller controls the multimedia portion to output broadcasting data of the selected subchannel.

28. The mobile terminal of claim 27, wherein upon selection of a subchannel through the user interface menu, the controller provides a signal indicating data type and ID of the selected subchannel to the multimedia portion.

29. The mobile terminal of claim 21, wherein upon selection of a subchannel through the user interface menu, the controller provides a signal indicating data type and ID of the selected subchannel to the multimedia portion.

30. The mobile terminal of claim 21, wherein upon receipt of a signal indicating data type and ID of a subchannel from the controller, the multimedia portion reads broadcasting data of the subchannel from the demodulator and outputs the broadcasting data.

31. A method of configuring a user interface in a mobile terminal for receiving terrestrial digital broadcasting data, comprising the steps of:

receiving digital broadcasting data corresponding to a frequency in response to a request for digital broadcasting corresponding to the frequency;

separating a main service channel (MSC) containing broadcasting data for subchannels and a fast information channel (FIC) providing information about the MSC from the digital broadcasting data; and acquiring analysis information by analyzing the FIC and configuring a user interface menu for the subchannels of the MSC using the analysis information.

32. The method of claim 31, wherein the subchannels include a video channel, an audio channel and a data channel.

33. The method of claim 31, further comprising the step of displaying the user interface menu.

34. The method of claim 33, further comprising the step of, upon selection of a subchannel through the user interface menu, outputting broadcasting data of the selected subchannel.

35. The method of claim 31, further comprising the step of storing the FIC.

36. The method of claim 31, further comprising the step of storing the analysis information.

37. The method of claim 36, wherein the analysis information includes an ensemble label, a service label, a service identifier (ID), a service data type, a service component ID, a subchannel ID and a subchannel data type.

38. The method of claim 31, wherein the analysis information includes at least one of an ensemble label, a service label, a service identifier (ID), a service data type, a service component ID, a subchannel ID and a subchannel data type.

39. The method of claim 31, further comprising the step of, upon selection of a subchannel through the user interface menu, outputting broadcasting data of the selected subchannel.

40. The method of claim 39, wherein the output step comprises the steps of:

detecting, upon selection of a subchannel through the user interface menu, information about the selected subchannel; and reading broadcasting data corresponding to the detected subchannel information from the MSC and outputting the broadcasting data.

41. The method of claim 40, wherein the subchannel information includes data type and ID of the subchannel.

* * * * *